United States Patent [19]

Holgado et al.

[11] 4,209,414

[45] Jun. 24, 1980

[54] DUAL-PURPOSE HYDRAULIC FLUID

[75] Inventors: Rosauro V. Holgado, Bala Cynwyd; Philip Rakoff, Philadelphia, both of Pa.

[73] Assignee: E. F. Houghton and Co., Norristown, Pa.

[21] Appl. No.: 13,721

[22] Filed: Feb. 26, 1979

Related U.S. Application Data

[63] Continuation-in-part of Ser. No. 885,739, Mar. 13, 1978, abandoned.

[51] Int. Cl.[2] ..... C09K 5/00; C10M 3/18; C10M 3/26

[52] U.S. Cl. ..... 252/75; 252/49.6; 252/49.9; 252/51.5 A; 252/51.5 R; 252/77; 252/78.1

[58] Field of Search ..... 252/49.6, 49.9, 152.5 A, 252/51.5 R; 252/75, 77, 78.1

[56] References Cited

U.S. PATENT DOCUMENTS

| | | | |
|---|---|---|---|
| 2,959,547 | 11/1960 | Brillhart | 252/33.6 |
| 2,967,831 | 1/1961 | Hommer | 252/77 |
| 2,999,064 | 9/1961 | Sluhan | 252/34.7 |
| 3,062,747 | 11/1962 | Fife et al. | 252/73 |
| 3,235,499 | 2/1966 | Waldmann | 252/49.6 |
| 3,346,501 | 10/1967 | Boehmer | 252/73 |
| 3,350,316 | 10/1967 | Berger et al. | 252/75 |
| 3,472,781 | 10/1969 | Ziemba | 252/75 |
| 3,498,921 | 3/1970 | Edwards | 252/73 |
| 3,625,899 | 12/1971 | Sawyer et al. | 252/78.1 |
| 3,645,901 | 2/1972 | Matson | 252/75 |
| 3,719,598 | 3/1973 | King | 252/33.4 |
| 3,788,988 | 1/1974 | Dubourg | 252/32.5 |
| 3,965,712 | 6/1976 | Abrams | 72/42 |
| 3,969,236 | 7/1976 | Waldstein | 252/49.5 |
| 3,972,822 | 8/1976 | Sato et al. | 252/78.1 |
| 4,010,105 | 3/1977 | Holgado | 252/77 |
| 4,151,101 | 4/1979 | Anzenberger et al. | 252/49.6 |

FOREIGN PATENT DOCUMENTS 768226 2/1957 United Kingdom .

*Primary Examiner*—P. E. Willis, Jr.
*Attorney, Agent, or Firm*—Howson and Howson

[57] ABSTRACT

A synthetic dual-purpose fluid for use as a hydraulic fluid and in metal cutting operations, particularly where hydraulic fluid leakage cannot be tolerated in hydraulically operated machines designed for metal cutting purposes. The fluid contains in combination 50–70% of an alkylene glycol, 10 to 25% of an alkanol amine, up to 10% boric acid, and 2 to 25% of a phosphate-modified condensation product of a fatty acid and a dialkanolamine.

10 Claims, No Drawings

DUAL-PURPOSE HYDRAULIC FLUID

This application is a continuation-in-part of our earlier filed application Ser. No. 885,739 filed Mar. 13, 1978 now abandoned.

BACKGROUND OF THE INVENTION

Metal cutting machines, for the most part, are hydraulically operated. The cutting fluids used in such machines are generally water-based so as to control temperature while providing adequate lubrication. The hydraulic oils used in metal cutting machines, with few exceptions, have not been compatible with water-based cutting fluids, so that leakage of the former into the cutting fluids has resulted in reduced effectiveness of such fluids, leading to lost production due to the necessity of premature dumping of the cutting fluids. Thus, there has been a need for hydraulic fluids which may be used in metal cutting machines which, should they leak into the aqueous metal cutting fluids employed in such machines, do not interfere with the effectiveness of such cutting fluids.

DETAILS OF THE INVENTION

This invention relates to a synthetic dual-purpose fluid for use as a hydraulic fluid and in metal cutting operations, which fluid obviates the problems of cutting fluid contamination hereinabove discussed. The fluid can be used as a hydraulic fluid either "neat", or diluted with water, depending upon the particular hydraulic system, particularly the hydraulic pumps, in which it is used. In addition, and of particular importance is the fact that the dual-purpose fluid of this invention can be used in metal cutting machines where heretofore contamination of the cutting fluid by the hydraulic fluid could not be tolerated. The novel dual-purpose fluid of this invention may advantageously be combined with water in a wide variety of proportions to produce effective coolants or cutting fluids for metals. Thus, even if used neat as the hydraulic fluid of a metal cutting machine, should the fluid leak into the aqueous base cutting fluid, no adverse effect results. Thus, the dual-purpose fluid avoids premature dumping of the cooling fluid into which it may leak with concomitant savings.

The dual-purpose fluid of this invention comprises in combination an alkylene glycol, an alkanol amine, boric acid, and a phosphate-modified condensation product of a fatty acid and a dialkanolamine.

The alkylene glycol component of the dual-purpose fluid may comprise mono- and polyalkylene glycols which are both water soluble and provide the fluid with the desired viscosity. The alkylene glycol provides the fluid with the necessary lubricity whether used as a hydraulic fluid or cutting fluid. In addition, when present in an aqueous-base cutting fluid, upon evaporation of water where remains on the metal workpiece a non-tacky residue which is readily removed.

The mono-alkylene glycols which are used in the dual-purpose fluid have the formula $HO(C_nH_{2n})OH$ wherein n is an integer from 2 to 6. Thus, the mono-alkylene glycols include ethylene, propylene, butylene, pentylene and hexylene glycol. The polyglycols are the water soluble polyoxyalkylene glycols, such as the polyethylene and polypropylene glycols, as well as poly (oxyethylene-oxy-1, 2-propylene) glycols. A preferred polyglycol is diethylene glycol.

The alkylene glycol component of the dual-purpose fluid generally will comprise from about 50 to about 70percent by total weight of the fluid, preferred amounts of this component being in the range of from about 63 to 69 percent.

The second component of the dual-purpose fluid is an alkanolamine having the general formula $H_{3-x}N(ROH)_x$ in which R is an alkylene group containing from 2 to 3 carbon atoms, and x is 1, 2 or 3. Thus, for example, R may be ethylene, propylene or isopropylene. Specific examples of alkanolamines which may be used in accordance with this invention are monoethanolamine, diethanolamine, triethanolamine, mixtures of mono-, di- and triethanolamine, monopropanolamine, dipropanolamine, tripropanolamine and mixtures of these propanolamines, mono-, di- and triisopropanolamine and mixtures of such isopropanolamines. A preferred alkanolamine is diethanolamine.

The alkanolamine component of the dual-purpose fluid should be present in an amount of from about 10 to about 25 percent, by weight of the total fluid composition. Preferably, the fluid will contain on the order of 15 to 20percent of the alkanolamine. When one or a mixture of of the above-described alkanolamines is present in these amounts, it provides the fluid with the desired alkalinity to minimize corrosion of metal parts in the hydraulic system. In addition, some of the alkanolamine may react with the third component of the fluid, namely boric acid, when present, to provide the fluid with biocidal properties. This is important in controlling the bacteria count of aqueous hydraulic fluids and cutting fluids formed of the dual-purpose fluid of this invention since bacteria generally are present in the water used in forming such aqueous fluids.

As noted, the third component of the dual-purpose fluid is boric acid which generally may be present in an amount up to about 10 percent, preferably, up to about 6 percent, by weight of the fluid. If present, such component generally may comprise about 2 to 5 percent of the fluid.

The fourth constituent of the novel dual-purpose fluid is a phosphate-modified condensation product of a fatty acid and a dialkanolamine. Such condensation product increases the lubricity and antiwear properties of the dual-purpose fluid, while at the same time enhancing the extreme pressure properties. This condensation product may be prepared by reacting about one mole of the fatty acid with about 1.5 moles of dialkanolamine in the presence of a small amount, e.g. about 0.03 moles, of phosphoric acid at temperatures on the order of 150° to 160° C. with removal of water of condensation. When the free fatty acid content has decreased to the range of about 5.8% or less, measured as oleic acid, the reaction is stopped. The condensate thus produced should have a total alkalinity of about 10 percent by weight, expressed as KOH.

From the method of formation it would appear that the condensate is a simple mixture of fatty acid-diethanolamide with excess diethanolamine, a portion of one or both having reacted with the phosphoric acid. However, a mixture of the first two-named components do not behave like the condensate.

The fatty acids used in preparation of the condensates generally should contain from 12 to 18 carbon atoms and may be saturated or unsaturated, or mixtures of both. Thus, fatty acids suitable for use in preparing the condensates include lauric, myristic, palmitic, stearic and oleic acids. A preferred fatty acid reactant is a mixture of stearic and oleic acids.

Dialkanolamines which have been found useful in preparing the condensates have the general formula $HN(C_nH_{2n}OH)_2$, in which n is 2 or 3. A particularly preferred dialkanolamine is diethanolamine, although other suitable dialkanolamines from which the condensates may be formed include dipropanolamine and diisopropanolamine.

The component of the dual-purpose fluid comprising a phosphate-modified condensation product of a fatty acid and a dialkanolamine should comprise from about 2 to about 25 percent, by weight, of the total fluid. Preferred amounts of condensate generally are in the range of from about 12to about 18 percent.

In addition to the above-identified four constituents of the dual-purpose fluid of this invention, there may also be present small amounts of other materials which impart additional desirable properties to the fluid.

For example, the fluid may contain from about 0.1 to about 1 percent, by weight, of a material which provides nonferrous metal parts, such as those made of brass, bronze, etc., of the hydraulic system with corrosion protection. Typical of such corrosion inhibitors are benzotriazole, tolyltriazole and sodium MBT, the former being a preferred inhibitor of this type. Preferably, such inhibitor is present to the extent of about 0.1 to 1.0 percent of the total composition.

It was found that by the inclusion of minor quantities, e.g. about 0.1 to 1 percent, by weight, preferably about 0.2 to 0.6 percent of mono alkyl ethers of polyoxyalkylene glycols in the dual-purpose fluid, the wear of hydraulic pump arts in the hydraulic system in which the fluid is employed can be considerably reduced. Apparently such materials provide the pump parts with a lubricant film to increase the life of pump parts. These compounds, which contain both oxyethylene and oxy-1, 2-propylene groups, are also referred to monohydroxy oxyethylene oxy-1, 2-propylene aliphatic monoethers in which the ethylene oxide and 1, 2-propylene oxide are combined therein as oxyethylene and oxy-1, 2-propylene groups. Ordinarily in such compounds the oxyethylene and oxy-1, 2-propylene groups are combined in a ratio which is at least one-third part of 1, 2-propylene oxide for each part of ethylene oxide. Such compounds generally will have an average molecular weight of at least 500, of which at least 300 is attributable to the oxyethylene and oxy-1, 2-propylene groups.

These ethers and processes for their production which involve reacting together an alcohol, e.g. butanol, ethylene oxide and 1,2-propylene oxide, are described in U.S. Pat. No. 2,425,755. The resulting product is a mixture of ethers, which mixture has certain physical properties and an average molecular weight. A preferred compound of this type is a mixture of butyl monoethers having an average molecular weight of about 1500. In such ethers preferably there is about a 1:1 ratio of 1,2-polypropylene oxide to ethylene oxide groups.

Although the dual-purpose fluid of this invention can be used neat as a hydraulic fluid, it also can be diluted with a wide range of proportions of water to provide aqueous base hydraulic fluids and metal cutting and cooling fluids. It was noted that such aqueous systems tended to foam. Accordingly, a small amount of a defoamer advantageously can be included in the fluid to control undesirable foaming. Particularly useful antifoam agents are the polydimethyl silicone oils of the general formula $(—(CH_3)_2\ SiO—)_n$. These materials may generally be used in amounts ranging from about 0.1 to 1 percent, preferably 0.2 to 0.6 percent.

When this dual-purpose fluid is used continuously in diluted form, and especially in the absence of boric acid, it is found beneficial to incorporate in the formula up to about 2 percent, preferably 0.1 to 0.5 percent of a biocide selected from the group consisting of sodium 2-pyridimethiol 1-oxide and a mixture of 4-(2-nitro-butyl)-morpholine and 4,4'-(2-ethyl-2-nitro-trimethylene) dimorpholine. The inclusion of this biocide gives the diluted fluid adequate biological long-term stability.

Sometimes it is desirable to impart a particular color to the dual-purpose fluid, and up to about 0.1 percent of a phosphorescent dye may be useful for such purpose.

In preparing the novel dual-purpose fluid of this invention the alkylene glycol, alkanolamine, and phosphate-modified condensation product of fatty acid and dialkanolamine, in the above-stated proportions, may be charged to a clean, oil-free tank provided with heating and agitating means where the mixture is heated with agitation to 45° to 75° C. until all components have dissolved. For relatively large commercial size batches this may take as much as one-half hour.

The heat is then turned off and the remainder of the constituents, generally with the exception of the dye, in the specified proportions, are added and samples are taken to determine properties such as stability, viscosity, and total alkalinity. In addition, the fluid may be subjected to various physical tests, such as the Falex Test, frequently carried out to determine the operating characteristics of the fluid.

The dual-purpose fluids of this invention, prior to addition of dye, are slightly hazy clear to hazy brown in color, are stable at both 40° F. and 120° F., and have a viscosity in the range of 145 to 175 SUS at 40° F. and 160 to 190 SUS at 100° F. The total alkalinity, as KOH, of the fluids is about 9.2%±1% and free fatty acid, as oleic acid, is about 1.4%±0.5%.

The dual-purpose fluids of this invention are particularly useful as hydraulic fluids. Depending upon the pump design of the hydraulic system, the novel fluid can be used neat or diluted with water over a wide range of porportions, e.g. 5 to 97.5 percent water, based on the total weight of the aqueous composition. When used as a hydraulic fluid, the dual-purpose fluid is preferably used neat, or combined with up to 10 percent water.

As stated above, the fluid can be diluted with water to provide an effective metal cutting and cooling fluid. Usually, for such purposes the fluid will be combined with about 5 to 95 percent water.

Advantageously, since the dual-purpose fluid when combined with water is useful as a metal cutting fluid, should the fluid also be used in neat form as the hydraulic fluid for a cutting machine, and should any of the neat fluid leak into the cutting fluid, no harm results.

A further understanding of the invention will be had from the following examples.

EXAMPLE 1

66.4 pounds of diethylene glycol, 15 pounds of diethanolamine, and 0.2 pounds of benzotriazole were charged to a clean, oil-free tank fitted with heating means and an agitator. The temperature of the mixture was increased to about 45° C. with continued stirring. All of the solids dissolved in about one-half hour.

The heat was turned off and there was then added 15 pounds of a phosphate-modified condensation product of a dialkanolamine and a fatty acid, prepared as below, 0.5 pounds of a mixture of butyl monoethers of polyoxyalkylene glycols having an average M.W. of 1500 and a 1:1 ratio of oxyethylene to oxy-1, 2-propylene groups, 0.6 pounds of a dimethyl silicone oil anti-foaming agent, and 0.1 pound of biocide(sodium 2-pyridinethiol 1-oxide). Mixing was continued for about an additional three quarters of an hour to obtain a uniform blend.

The condensate was prepared by reacting 1.5 moles of diethanolamine with one mole of a mixture of stearic and oleic acids in the prexence of 0.03 moles of phosphoric acid at a temperature of about 160° C. The reaction was discontinued when the free fatty acid content, measured as oleic acid, was about 5.8%. The total alkalinity of the condensate was 10%±1, measured as KOH.

The dual-purpose fluid, prepared as above, was slightly hazy brown in color, and had the properties given in Table I, below:

TABLE I

| Viscosity | SUS | cST |
|---|---|---|
| at 100° F. | 176 | 37.7 |
| at 40 ° C. | 159 | 33.9 |
| at 100° C. | 41.1 | 4.5 |
| Specific Gravity at 60° F. | 1.068 | |
| Pour Point, °F. | 21 (−6° C.) | |
| Flash Point, °F. | 295 (146° C.) | |
| Fire Point, °F. | 315 (158° C.) | |
| pH Neat | 10.3 | |
| pH 5% aqueous solution | 9.3 | |
| Corrosion Tests: | | |
| Rust Test (ASTM D-665-A) | 96 hours | |
| Copper Strip (ASTM D-130) | 1a | |

EXAMPLE 2

5 parts of the dual-purpose fluid of Example 1 were diluted with 95 parts water and subjected to the following pump test.

TABLE II

| | |
|---|---|
| Test Conditions | |
| Pump | Vickers PFB-5 In-Line Piston |
| Pressure | 1000 psi |
| Output | 5 gpm |
| Filter Size | 25 microns |
| Temperature | 115–120° F. |
| Duration | 2020 hrs. |
| Test Results | |
| Total Piston Wear Loss | 353 mgs. |
| Total Piston Wear Rate | 0.17 mgs./hr. |
| Piston Plate Wear Loss | 234 mgs. |
| Piston Plate Wear Rate | 0.16 mgs./hr. |
| Initial Total Piston Knuckle-Joint Clearance | 0.019 in. |
| Final Total Piston Knuckle-Joint Clearance | 0.049 in. |
| Fluid Properties | |
| Initial pH | 9.3 |
| Final pH | 9.1 |

EXAMPLE 3

The dual-purpose fluid of Example 1 (neat) was subjected to the following pump tests:

TABLE III

| | Test Conditions |
|---|---|
| Pump | Vickers V-104-C-10 |
| Pressure, psi | 600 |
| Output, gpm | 7.5 |
| Filter Size, microns | 10.0 |
| System Capacity, gallons | 5.0 |
| Temperature, °F. | 115–120 |
| Duration, hrs. | 192 |
| | Test Results |
| Ring Wear Loss, mgs. | 13 |
| Vanes Wear Loss, mgs. | 5 |
| Total Wear Loss, mgs. | 18 |
| Wear Rate, mgs/hour | 0.09 |
| | Fluid Properties |
| Initial Viscosity at 100° F., SUS | 176 |
| Final Viscosity at 100° F., SUS | 180 |
| Viscosity Change, % | 2.27 |
| Initial pH | 10.3 |
| Final pH | 10.2 |
| pH Change | 0.1 |

The test data obtained as a result of carrying out the pump tests described in Examples 2 and 3 show the suitability of the dual purpose fluid of this invention as a hydraulic fluid, used neat and diluted water.

EXAMPLE 4

63.4 pounds of diethylene glycol, 15 pounds of diethanolamine, 5 pounds of boric acid, and 0.2 pounds of benzotriazole were charged to a clean, oil-free tank fitted with heating means and an agitator. The temperature of the mixture was increased to about 75° C. with continued stirring. All of the solids dissolved in about one-half hour.

The heat was turned off and there was then added 15 pounds of a phosphate-modified condensation product of a dialkanolamine and a fatty acid, prepared as below, 0.5 pounds of a mixture of butyl monoethers of polyoxyalkylene glycols having an average M.W. of 4800 and a 1:1 ratio of oxyethylene to oxy-1, 2-propylene groups, and 0.6 pounds of a dimethyl silicone oil anti-foaming agent. Mixing was continued for about an additional three quarters of an hour to obtain a uniform blend.

The condensate was prepared by reacting 1.5 moles of diethanolamine with one mole of a mixture of stearic and oleic acids in the presence of 0.03 moles of phosphoric acid at a temperature of about 160° C. The reaction was discontinued when the free fatty acid content, measured as oleic acid, was about 5.8%. The total alkalinity of the condensate was 10%±1, measured as KOH.

The dual-purpose fluid, prepared as above, was slightly hazy brown in color, and had the properties given in Table IV, below:

TABLE IV

| Viscosity | SUS | cST |
|---|---|---|
| at 100° F. | 285 | 61.0 |
| at 40° C. | 262 | 56.5 |
| at 100° C. | 45.4 | 5.9 |
| Specific Gravity at 60° F. | 1.125 | |
| Pour Point, °F. | 20 (−6° C.) | |
| Flash Point, °F. | 315 (157° C.) | |
| Fire Point, °F. | 330(165° C.) | |
| pH Neat | 10.2 | |
| pH 5% aqueous solution | 9.2 | |
| Corrosion Tests: | | |
| Rust Test (ASTM D-665-A) | 96 hours | |
| Copper Strip (ASTM D-130) | 1a | |

EXAMPLE 5

A composition comprising 5 percent by weight of the dual-purpose fluid of Example 4 and 95 percent water (hardness 100 ppm) was subjected to the Falex (Cornell) Extreme Pressure and Wear Test. This test measures bearing load and resulting wear produced by extreme pressure forces under constant speed and constant temperature for the test fluid. The test speed is placed in the lubricant pan and heated to a predescribed temperature. The test blocks are placed in the jaws and the journal pin held in the driving shaft by a brass shearing pin.

The cup was filled to the mark with the above-described fluid. The jaw load was turned up to 1000 pounds and back to 250 pounds before starting. The jaw load was kept at 250 pounds for 60 seconds before proceeding to 500 pounds, and the load was kept at 30 seconds before going to the next 250 pounds incremental increase.

The results obtained with the aqueous base fluid of this invention and that of a typical synthetic oil are set forth in Table V.

TABLE V

| Jaw Load Pounds | Torque - Inch/Pounds 5% Dual-Purpose Fluid in Water | Typical Synthetic Oil |
|---|---|---|
| 250 | 5 | 10 |
| 500 | 10 | 25 |
| 750 | 15 | 35 |
| 1000 | 22 | 40 |
| 1250 | 25 | 60 |
| 1500 | 30 | 60 |
| 1750 | 37 | 60 |
| 2000 | 40 | 70 |
| 2250 | 43 | 68 |
| 2500 | 45 | 60 |
| 2750 | 46 | 60 |
| 3000 | 47 | 60 |
| 3250 | 48 | Failed |
| 3500 | 50 | |
| 3750 | 51 | |
| 4000 | 53 | |
| 4250 | 57 | |
| 4500 | 59 | |
| | Passed 4500 Pound Load | |

EXAMPLE 6

5 parts of the dual-purpose fluid of Example 4 were diluted with 95 parts water and subjected to the following pump test.

TABLE VI

| | |
|---|---|
| **Test Conditions** | |
| Pump | Vickers PFB-5 In-Line Piston |
| Pressure | 1000 psi |
| Output | 5 gpm |
| Filter Size | 25 microns |
| Temperature | 115-120° F. |
| Duration | 528 hrs. |
| **Test Results** | |
| Total Piston Wear Loss | 166 mgs. |
| Total Piston Wear Rate | 0.31 mgs./hr. |
| Piston Plate Wear Loss | 325 mgs. |
| Piston PLate Wear Rate | 0.62 mgs./hr. |
| Initial Total Piston Knuckle-Joint Clearance | 0.018 in. |
| Final Total Piston Knuckle-Joint Clearance | 0.031 in. |
| **Fluid Properties** | |
| Initial pH | 9.2 |

TABLE VI-continued

| | |
|---|---|
| Final pH | 9.2 |

EXAMPLE 7

The dual-purpose fluid of Example 4 (neat) was subjected to the following pump tests:

TABLE VII

| | Test Conditions Vickers | Vickers |
|---|---|---|
| Pump | V-104-C-10 | V-104-C-10 |
| Pressure, psi | 600 | 1000 |
| Output, gpm | 7.5 | 7.5 |
| Filter Size, microns | 10.0 | 10.0 |
| System Capacity, gallons | 5.0 | 5.0 |
| Temperature, °F. | 115-120 | 115-120 |
| Duration, hrs. | 812 | 188 |
| **Test Results** | | |
| Ring Wear Loss, mgs. | 29 | 101 |
| Vanes Wear Loss, mgs. | 11 | 3 |
| Total Wear Loss, mgs. | 30 | 104 |
| Wear Rate, mgs/hour | 0.04 | 0.55 |
| **Fluid Properties** | | |
| Initial Viscosity at 100° F., SUS | 285 | 289 |
| Final Viscosity at 100°F., SUS | 292 | 291 |
| Viscosity Change, % | +2.5 | +0.7 |
| Initial pH | 10.1 | 9.7 |
| Final pH | 10.1 | 9.8 |
| pH Change | Nil | +0.1 |

The test data obtained as a result of carrying out the pump tests described in Examples 2 and 3 and 6 and 7 show the suitability of the dual purpose fluid of this invention as a hydraulic fluid, used neat and diluted with water.

What is claimed is:

1. A dual-purpose fluid for use as a hydraulic fluid and in metal cutting operations comprising:

(A) from about 50 to about 70 percent, by total weight of said fluid, of a water-soluble alkylene glycol selected from the group consisting of monoalkylene glycols having the formula $HO(C_nH_{2n})OH$ where n is an integer from 2 to 6, and polyoxyalkylene glycols;

(B) from about 10 to about 25 percent of an alkanolamine of the general formula $H_{3-x}N(ROH)_x$ in which R is an alkylene group containing from 2 to 3 carbon atoms and x is 1, 2 or 3;

(C) up to about 10 percent boric acid, and (D) from about 2 to about 25 percent of a phosphate-modified condensation product obtained by reacting about 1.5 moles of a dialkanolamine of the formula $HN(C_nH_{2n}OH)_2$ in which n is 2 or 3, with about 1 mole of a fatty acid containing from 12to 18 carbon atoms, in the presence of about 0.03 moles of phosphoric acid, and being continued until the free fatty acid content of the reaction mixture has been reduced to at least about 5.8 percent.

2. The fluid of claim 1 in which said alkylene glycol comprises from about 63 to 69 percent, said alkanolamine comprises from about 15 to 20 percent, said boric acid comprises up to about 6 percent, and said condensation product comprises from about 10 to 15 percent of said fluid.

3. The fluid of claim 1 which contains from about 0.1 to 1 percent of a corrosion inhibitor selected from the group consisting of benzotriazole, to tolylotriazole and sodium MBT (mercapto benzo thiazole); from about 0.1 to 1 percent of a film forming lubricant which is a monohydroxy oxyethylene oxy-1, 2-propylene aliphatic monoether in which the ethylene oxide and 1, 2-propylene oxide are combined therein as oxyethylene and oxy-1, 2-propylene groups, said monoether having an average molecular weight of at least 500, from about 0.1 to 1 percent of a silicone oil anti-foaming agent, and up to about 2 percent of a biocide selected from the group consisting of sodium 2-pyridinethiol 1-oxide and a mixture of 4-(2-nitro-butyl) morpholine and 4,4'-(2-ethyl-2-nitro-trimethylene) dimorpholine.

4. The fluid of claim 2 which contains from about 0.1 to about 0.5 percent of benzotriazole, from about 0.2 to about 0.6 percent of a mixture of monohydroxy oxyethylene oxy-1, 2-propylene butyl monoethers having an average molecular weight of 1500 and in which the ratio of ethylene oxide groups to oxy-1, 2-propylene oxide groups is about 1:1; from about 0.2 to 0.6 percent of a silicone oil anti-foam agent, up to about 0.2 percent of sodium-2-pyridinethiol-1-oxide, and up to about 0.1 percent of a dye.

5. A dual-purpose fluid for use as a hydraulic fluid and in metal cutting operation comprising:

(A) about 65 percent by total weight of said fluid of diethyleneglycol;

(B) about 15 percent of diethanolamine;

(C) up to about 5 percent boric acid, and (D) about 15 percent of a phosphate-modified condensation product obtained by reacting about 1.5 moles of a diethanolamine with about one mole of a mixture of stearic and oleic acids in the presence of about 0.03 moles of phosphoric acid, and being continued until the free fatty acid content of said reaction mixture has been reduced to at least about 5.8 percent.

6. The fluid of claim 5 containing about 0.5 percent of a mixture of monohydroxy oxyethylene oxy-1, 2-propylene butyl monoethers having an average molecular weight of 1500 and in which the ratio of ethylene oxide groups to oxy-1, 2-propylene oxide groups is about 1:1, and about 0.6 percent of a dimethyl silicone oil anti-foaming agent.

7. A hydraulic fluid comprising from about 2.5 to about 95 percent of the dual-purpose fluid of claim 1 and about 5 to about 97.5 percent water, said percentages being by weight based on the total weight of said hydraulic fluid.

8. A hydraulic fluid comprising from about 90 to about 95 percent of said dual-purpose fluid of claim 2 and about 5 to about 10 percent water, said percentages being by weight based on the total weight of said hydraulic fluid.

9. A metal cutting fluid comprising from about 5 to about 95 percent of the dual-purpose fluid of claim 1 and from about 5 to about 95 percent water, based on the total weight of said cutting fluid.

10. A metal cutting fluid comprising from about 5 to about 95 percent of the dual-purpose fluid of claim 2 and from about 5 to about 95 percent water, based on the total weight of said cutting fluid.

* * * * *